United States Patent [19]

Nagayasu et al.

[11] 4,207,376

[45] Jun. 10, 1980

[54] ANTISTATIC FILAMENTS HAVING AN INTERNAL LAYER COMPRISING CARBON PARTICLES AND PROCESS FOR PREPARATION THEREOF

[75] Inventors: Tadahito Nagayasu; Tomitake Higuchi, both of Nagoyashi, Japan

[73] Assignee: Toray Industries, Inc., Tokyo, Japan

[21] Appl. No.: 48,446

[22] Filed: Jun. 14, 1979

[51] Int. Cl.[2] ..... B29F 3/10; B32B 27/02; B32B 27/14; B32B 27/18

[52] U.S. Cl. ..... 428/367; 264/171; 428/368; 428/373; 428/395; 428/397

[58] Field of Search ..... 428/367, 368, 373, 395, 428/397; 264/171

[56] References Cited

U.S. PATENT DOCUMENTS

| | | | |
|---|---|---|---|
| 2,932,079 | 4/1960 | Dietzsch et al. | 428/397 |
| 3,658,634 | 4/1972 | Yanagi et al. | 428/373 |
| 3,725,192 | 4/1973 | Satoshi et al. | 428/397 |
| 3,803,453 | 4/1974 | Hall | 428/375 |
| 3,924,045 | 12/1975 | Ogasawara et al. | 428/397 |
| 3,969,559 | 7/1976 | Boe | 428/397 |
| 4,045,949 | 9/1977 | Paton et al. | 428/367 |
| 4,061,827 | 12/1977 | Gould | 428/373 |

*Primary Examiner*—James C. Cannon

*Attorney, Agent, or Firm*—Armstrong, Nikaido, Marmelstein & Kubovcik

[57] ABSTRACT

An antistatic composite filament is disclosed, which has a three-layer structure including a core layer, a sheath layer and an intermediate layer, each of which is continuous in the axial direction of the filament. The core layer is composed of an oriented and crystallized, electrically non-conductive synthetic polymer. The sheath layer is composed of a synthetic polymer of the same kind as of the polymer constituting the core layer. The intermediate layer is composed of an electrically conductive synthetic polymer containing carbon black dispersed therein and is present in the entire intermediate area between the core layer and sheath layer. This filament is advantageously used as material for an antistatic carpet and/or dark color articles of wear such as uniforms or the like.

6 Claims, 4 Drawing Figures

ANTISTATIC FILAMENTS HAVING AN INTERNAL LAYER COMPRISING CARBON PARTICLES AND PROCESS FOR PREPARATION THEREOF

BACKGROUND OF THE INVENTION (1) Field of the Invention

The present invention relates to a three-layer composite antistatic filament comprising layer including electrically conductive carbon black dispersed therein and a process for the preparation thereof.

(2) Description of the Prior Art

As known antistatic composite filaments having a layer containing electrically conductive carbon black, the following filaments can be mentioned.

(A) A two-layer composite filament comprising a core layer having electrically conductive carbon black dispersed therein and an electrically non-conductive sheath layer (see Japanese Patent Publication No. 31450/77).

(B) A two-layer composite filament comprising a sheath layer containing electrically conductive carbon black and an electrically non-conductive core layer (see Japanese Patent Application Laid-Open Specification No. 48715/73).

(C) A composite filament comprising an electrically conductive layer having electrically conductive carbon black dispersed therein and an electrically non-conductive layer, in which said two layers are bonded to each other asymmetrically (see Japanese Patent Application Laid-Open Specification No. 143723/76).

Cross-sections of typical instances of these known composite filaments are shown in FIG. 1. In the filament shown in FIG. 1-A, an electrically conductive layer 2 constitutes the core and an electrically non-conductive layer 1 constitutes the sheath. In the filament shown in FIG. 1-B, an electrically non-conductive layer 1 constitutes the core and an electrically conductive layer 2 constitutes the sheath. In the filament shown in FIG. 1-C, electrically conductive layer 2 and electrically non-conductive layer 1 are bonded to each other asymmetrically.

In these antistatic composite filaments, a synthetic polymer having finely divided, electrically conductive carbon black dispersed therein at a high concentration is used so as to impart an intended low electric resistance to the final composite filament. This carbon black-dispersed synthetic polymer is, however, very poor in the yarn forming property and a filamentary yarn having practical properties cannot be obtained from this polymer. Accordingly, this carbon black-dispersed synthetic polymer should be composite-spun or combined with a synthetic polymer excellent in the fiber forming property to improve the yarn forming property of the carbon black-dispersed synthetic polymer and obtain a filamentary yarn having a sufficient strength.

In the case of the composite filament shown in FIG. 1-A, in order to improve the fiber forming property and yarn forming property sufficiently, the thickness of the sheath should inevitably be increased and therefore, the electric conductivity given by electrically conductive carbon black dispersed in the core should inevitably be reduced to a low level. For example, in Japanese Patent Application Laid-Open Specification No. 143723/76 it is pointed out that the composite filament shown in FIG. 1-A is not effective at all for eliminating static charges below the level of 3,500 volts, which is ordinarily sensed by men. Accordingly, the composite filament of the type shown in FIG. 1-A involves a problem of a low antistatic effect.

In the case of the composite filament shown in FIG. 1-B, since a carbon black-containing layer is present as the outermost layer, the black color inherent of carbon black is very conspicuous in a yarn formed from such filament, and if this yarn is used for the manufacture of a knitted or woven fabric or a carpet, the product inevitably has an undesirable appearance. Moreover, if this composite filament undergoes a bending or frictional action during subsequent processing steps, carbon black present in the outermost layer is peeled or taken out and there is brought about a defect of reduction of the antistatic effect.

Also in the filament shown in FIG. 1-C, the layer of a polymer having electrically conductive carbon black dispersed therein is exposed to the surface of the filament, though not along the entire periphery of the filament. Accordingly, this composite filament involves a problem of a poor appearance as well as the filament shown in FIG. 1-B. Moreover, this filament has a defect that black pieces are readily caused to fall down. Moreover, this composite filament involves fundamental defects inherent of a bonded type composite filament. More specifically, bending is caused on the surface of a spinneret at the spinning step, and crimps are readily formed when the filament is drawn.

In each of the filaments shown in FIGS. 1-B and 1-C, since a carbon black-containing layer is not present in the interior but is exposed directly to the filament surface. Accordingly, in order to attain a good fiber forming property in this layer, the content of carbon black should be controlled below a certain upper limit. Furthermore, if a yarn of this composite filament is subjected to subsequent processing such as false twisting, fusion bonding of filaments is caused unless the melting or softening point of the synthetic polymer containing carbon black is lower than the melting or softening point of an electrically nonconductive filament to be combined therewith.

SUMMARY OF THE INVENTION

It is a primary object of the present invention to overcome the foregoing defects and disadvantages involved in the convention techniques, make it possible to composite-spin stably a synthetic polymer having electrically conductive carbon black dispersed therein with a fiber-forming synthetic polymer, and provide an antistatic composite filament having sufficiently practical antistatic property and strength and a process for the preparation of such antistatic composite filament.

In accordance with one fundamental aspect of the present invention, this and other objects can be attained by an antistatic composite filament having a three-layer structure comprising a core composed of an oriented and crystallized, electrically non-conductive synthetic polymer, a sheath composed of an oriented and crystallized synthetic polymer of the same kind as of the synthetic polymer of the core and a layer of a synthetic polymer having electrically conductive carbon dispersed therein, which is present in the entire intermediate area between the core and sheath.

In accordance with another fundamental aspect of the present invention, there is provided a process for the preparation of antistatic composite filaments having the above-mentioned structure, which comprises dividing a molten, electrically non-conductive synthetic polymer into two streams of core and sheath components in a spinneret pack, flowing a stream of a molten synthetic polymer having electrically conductive carbon black dispersed therein around the periphery of the stream of the core component to form a two-layer combined stream, flowing the stream of the sheath component around the periphery of the so formed two-layer combined stream to form a three-layer stream, extruding said three-layer stream from a spinneret hole, and orienting and crystallizing at least the core and sheath components.

DETAILED DESCRIPTION OF THE PREFERRED EMBODIMENTS

The present invention will now be described in detail by reference to embodiments illustrated in the accompanying drawing.

Figure 1:
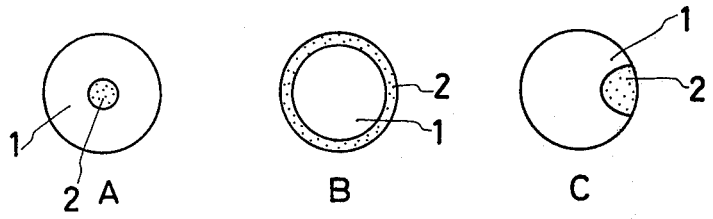
FIGS. 1-A, 1-B and 1-C are diagrams illustrating cross-sections of conventional composite filaments having a two-layer structure.
Figure 2:
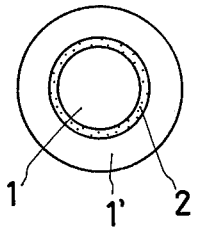
FIG. 2 is a diagram illustrating the cross-section of one embodiment of the three-layer composite filament according to the present invention.

Referring to FIG. 2 showing the cross-section of one embodiment of the antistatic filament according to the present invention, the antistatic filament comprises a core composed of an oriented and crystallized, electrically non-conductive synthetic polymer 1, a sheath composed of an oriented and crystallized, electrically non-conductive polymer 1' of the same kind as of the synthetic polymer of the core and a layer composed of an electrically conductive synthetic polymer 2 having electrically conductive carbon black dispersed therein, which is present in the entire intermediate area between the core and sheath.

Figure 3:
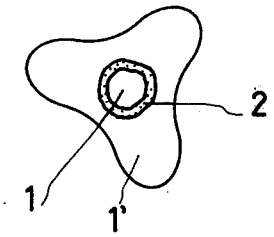
FIG. 3 is a diagram illustrating the cross-section of another embodiment of the three-layer composite filament according to the present invention.

Another embodiment of the antistatic filament according to the present invention is illustrated in FIG. 3.

In the antistatic filament according to the present invention, as the electrically non-conductive synthetic polymer constituting the sheath and core, a synthetic polymer having a good fiber forming property should be used. For example, polyamides and polyesters are preferably employed, and polyamides are especially preferred because polyamides are excellent over polyesters in the antistatic property, they can be drawn under heating at high temperatures and they have a good abrasion resistance.

In the present invention, the synthetic polymer as the sheath and core need not be composed solely of such polymer as mentioned above, but a synthetic polymer having an antistatic agent dispersed therein in the form of streaks in an amount of 0.5 to 5%, preferably 2 to 3% by weight may be used. As the antistatic agent, there can be mentioned, for example, polyalkylene glycols, polyalkylene ether glycols, derivatives of these glycols, polyalkylene oxide derivatives, polyether-polyamides, alkylene oxide adducts of polyamides and N-alkylpolyamides. Moreover, a delustrant such as titanium oxide may be incorporated in an amount of about 8% by weight into the synthetic polymer, especially one for the sheath.

The synthetic polymer that is used for the intermediate layer present between the core and sheath need not be particularly excellent in the fiber forming property because this polymer is not present in the outermost layer (sheath). For example, polyamides, polyesters, polyolefins, acrylic polymers and copolymers thereof may be used as the synthetic polymer for the intermediate layer. Of course, the use of a synthetic polymer excellent in the fiber forming property is preferred. Among fiber-forming synthetic polymers, polyamides and copolyamides are especially preferred because they have a relatively high antistatic property. In order to further improve the antistatic property, it is preferred that an antistatic agent such as mentioned above be incorporated into a polyamide or copolyamide in the form of streaks in an amount of 0.5 to 5%, preferably 0.5 to 3% by weight.

In the present invention, as the electrically conductive carbon black, there may be employed commercially available products such as Vulcan C, Vulcan PF, Vulcan XC72 and Vulcan XC72R manufactured and sold by Cabot Corp., and Condactex SC manufactured and sold by Columbia Carbon Co.

Dispersing of electrically conductive carbon black into the above-mentioned synthetic polymer can be performed according to known dispersing methods. For example, there may be adopted a method comprising dispersing carbon black at the polymerization step and a method comprising melt-kneading a chipped synthetic polymer with carbon black by mechanical means such as a mixer. When nylon-6 is selected and used as the synthetic polymer and electrically conductive carbon black is kneaded in nylon-6, it is preferred that the relative viscosity in sulfuric acid of nylon-6 be in the range of from about 2.1 to about 2.3. Furthermore, it is preferred that the amount of electrically conductive carbon black dispersed in the synthetic polymer be 10 to 60% by weight. In order to improve the yarn forming property of the composite filament and physical properties of the resulting filamentary yarn, it is especially preferred that the amount of carbon black dispersed in the synthetic polymer be 20 to 40% by weight.

In the present invention, it is an indispensable requirement that the core and sheath should be composed of an oriented and crystallized, electrically non-conductive synthetic polymer and a layer composed of an electrically conductive synthetic polymer having electrically conductive carbon black should be present in the entire intermediate area between the sheath and core, and the most characteristic feature of the antistatic filament of the present invention resides in this specific three-layer structure. It is preferred that these three layers be disposed coaxially with one another. The sectional configuration of the composite filament of the present invention is not limited to a circular coaxial configuration as shown in FIG. 2 but a non-circular sectional configuration as shown in FIG. 3 may be adopted. As the non-circular section, there may be adopted a triangular section and other optional non-circular sections. Also in the case of the non-circular section, it is preferred that the above three layers be substantially coaxially and rotationally symmetric with one another, because troubles inherent of the asymmetric sectional cofiguration, such as formation of crimps, are not caused.

The antistatic filament of the present invention can be prepared, for example, according to a process described below by reference to FIG. 4.

Figure 4:
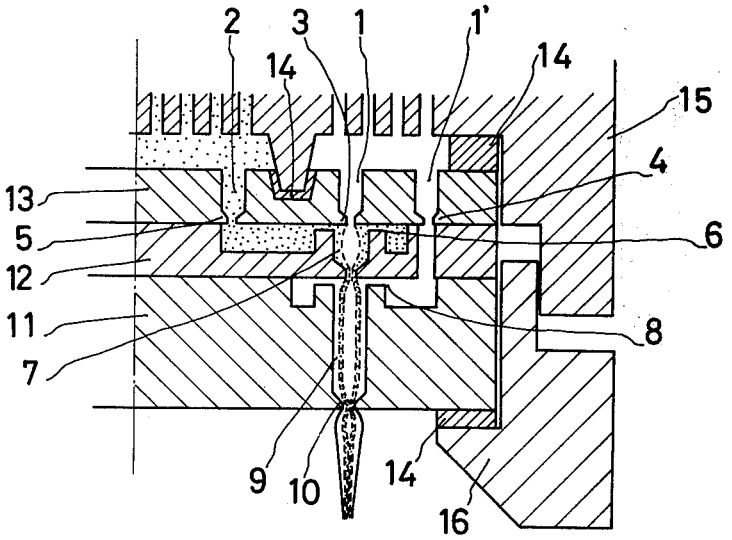
FIG. 4 is a sectional partial view showing a spinneret pack that is used for spinning of the three-layer composite filament according to the present invention.

FIG. 4 is a sectional view illustrating one embodiment of the spinneret pack that is used for practising the process for the preparation of the antistatic composite filament of the present invention.

This spinneret pack comprises cylindrical lower spinneret 11, middle spinneret 12 and upper spinneret 13, which are superposed and clamped by upper presser plate 15 and lower presser plate 16 through a packing 14.

Referring to FIG. 4, an electrically non-conductive synthetic polymer 1 which has been molten and filtered is flowed out while being metered through a metering hole 3, and an electrically conductive synthetic polymer 2, which has been molten and filtered, is flowed out while being metered through a metering hole 5. In a combining zone 6 formed around the metering hole 3 on the outlet side thereof, the electrically conductive synthetic polymer 2 is flowed to surround the periphery of the electrically non-conductive synthetic polymer 1 to form a two-layer stream 7. In a combining zone 8 formed around a passage for the two-layer stream 7 on the outlet side thereof, a part 1' of the above-mentioned electrically non-conductive polymer 1, that has been flowed out while being metered through a metering hole 4, is introduced around the periphery of the two-layer stream 7 to form a three-layer stream 9. This three-layer stream 9 is extruded from an extrusion hole 10 and the extrudate is taken out, oriented and crystallized by performing drawing under heating and heat treatment according to customary yarn-making procedures. The antistatic filament of the present invention is thus prepared.

As is apparent from the foregoing illustration, the antistatic filament of the present invention is characterized by a three-layer structure comprising a core composed of an oriented and crystallized, electrically non-conductive synthetic polymer, a sheath composed of an oriented and crystallized synthetic polymer of the same kind as of the synthetic polymer of the core and a layer composed of an electrically conductive synthetic polymer having electrically conductive carbon black dispersed therein, which is present in the entire intermediate area between the core and sheath. In the antistatic filament of the present invention, by virtue of this characteristic feature, the following effects can be attained.

(1) Since particles degrading the fiber forming property are not contained in the core and sheath (even if particles of a delsutrant are contained, the amount is only 2 to 8% by weight), there can be manifested a good fiber forming property and the filament per se has a good yarn forming property, and the resulting yarn is excellent in practical properties such as strength and friction characteristics, uniformity and so on.

(2) In the three-layer structure of the antistatic filament of the present invention, the layer composed of the electrically conductive synthetic polymer having electrically conductive carbon black dispersed therein is sandwiched between the core and sheath, each of which is composed of the electrically non-conductive synthetic polymer. Accordingly, the thickness of either the core or sheath can optionally be changed relatively according to the intended use of the antistatic filament. For example, in the case where the antistatic filament is used for a carpet, since it is preferred to attain a good antistatic effect and prevent black spots from appearing on the surface, the thickness of the core is reduced but the sheath is thickened (in this case, it also is preferred that an appropriate amount of a delustrant such as titanium oxide be incorporated into the sheath). When the antistatic filament is used for a black dress suit or uniform, it is preferred to make the black color appear on the surface and attain a good antistatic effect in the surface portion (because dusts adhering to a black suit become striking). Accordingly, in this case, the core is thickened while the thickness of the sheath is reduced.

(3) As pointed out above, in the three-layer structure of the antistatic filament of the present invention, the electrically conductive layer containing electrically conductive carbon black dispersed therein is not exposed to the surface of the filament and is sandwiched between the inner and outer layers of the oriented and crystallized, electrically non-conductive synthetic polymer. Accordingly, even if the electrically conductive layer is poor in the fiber forming property, the yarn manufacturing operation can be performed very smoothly without being influenced by the poor fiber forming property of the electrically conductive layer. Moreover, the practical properties of the resulting yarn are not influenced or degraded by the poor fiber forming property of the electrically conductive layer.

(4) Since the electrically conductive layer is covered with and protected by the sheath composed of the oriented and crystallized, electrically non-conductive synthetic polymer, even if the filament is scratched or heated in the yarn making process or at the subsequent processing step, the electrically conductive layer has a sufficient durability and hence, a very durable antistatic effect can be attained. Moreover, since carbon which is in the form of fine particles is not exposed to the outermost layer, the frictional characteristics are not degraded and the antistatic filament of the present invention can be treated and handled quite in the same manner as conventional synthetic filaments.

(5) Since the sectional configuration of the filament is axially symmetric (rotationally symmetric in the case of the non-circular section, for example, 120° rotationally symmetric in the case of the triangular section shown in FIG. 3), crimps are not formed at all by a heat treatment in the relaxed state or a chemical treatment. Accordingly, it is possible to eliminate process and product problems due to formation of crimps completely.

The process for the preparation of antistatic filaments according to the present invention is characterized in that an electrically non-conductive synthetic polymer, which has been molten, is divided into two streams, that is, a stream for the core component and a stream for the sheath component, in a spinneret pack, a molten, electrically conductive synthetic polymer having electrically conductive carbon black dispersed therein is flowed around the periphery of the core component stream to form a two-layer stream, the sheath component stream is flowed around the periphery of the so formed two-layer stream to form a three-layer stream, the so formed three-layer is extruded from a spinneret hole and at least the core and sheath components are oriented and crystallized. By virture of this characteristic feature, the following effects can be attained in the process of the present invention. Since a synthetic polymer of the same kind is used for both the core and sheath components, a three-layer filament, the preparation of which is very difficult according to the conventional techniques, can be manufactured very simply and easily. Moreover, the structure of the spinneret pack can be relatively simplified and the maintenance thereof can be remarkably facilitated. In other words, in the present invention, since such simple production process is employed, the yarn forming property can be improved.

As will readily be understood from the foregoing illustration, according to the present invention, there can be provided very stably and easily an excellent antistatic filament having an antistatic property sufficient for practical applications and giving a filamentary yarn excellent in practical properties such as strength, frictional characteristics and uniformity. Therefore, the antistatic filament of the present invention can be effectively sued for manufacture of various fibrous products such as carpets, dress suits and uniforms.

The effects of the present invention will now be described in detail by reference to the following Examples that by no means limit the scope of the invention.

EXAMPLE 1

Chipped nylon-6 (containing 2% by weight of titanium oxide) having a relative viscosity of 2.75 as measured in sulfuric acid was used as the electrically non-conductive core and sheath components, and the above-mentioned chipped nylon-6 containing 35% by weight of electrically conductive carbon black was used as the electrically conductive layer component. The former polymer was molten at 285° C. and the latter polymer was molten at 290° C. The melts were filtered through a White Alundum filter layer, introduced to a spinneret pack as shown in FIG. 4 (the extrusion hole had a Y-shaped section) and composite-spun.

The volume ratio of the electrically non-conductive core and sheath layers to the electrically conductive layer in the spun filament was adjusted to 95/5, and the volume ratio of the core to the sheath was adjusted to 10/85.

The so obtained undrawn spun filament was taken out at speed of 600 m/min. and was heat-drawn at a temperature of 170° C. and a draw ratio of 3.21 or 3.50.

The physical properties of the so obtained antistatic filamentary yarns were measured to obtain results shown in Table 1.

Table 1

| Physical Properties of Antistatic Filamentary Yarns of Present Invention | Sample No. 1 | Sample No. 2 |
|---|---|---|
| Draw ratio | 3.21 | 3.50 |
| Fineness | 24.2 D (3F) | 22.3 D (3F) |
| Strength | 3.04 g/d | 3.46 g/d |
| Elongation | 58.9% | 57.2% |
| Uster unevenness | 2.4% | 1.9% |
| Resistance* | 36 MΩ/cm | 60 MΩ/cm |

*Note
The resistance was determined according to the following method.

The sample was spread between insulated two electrode rods spaced by 10 cm from each other at a temperature of 20° C. and a relatively humidity of 65%, and the resistance value was measured by the Insulation Resistance Tester (Model 3213-15 manufactured by Yokogawa Electric Works, Ltd.). The measurement was made on 12 specimens with respect to each sample and the mean value of the resistance was calculated. The resistance was expressed by the value obtained by dividing the mean value by 10 cm.

The so obtained filamentary yarn was incorporated into a BCF carpet yarn of 1300 D-68 F at the yarn manufacturing step and was tufted at every 5 carpet yarns in a tufted carpet. The carpet was dyed into an orange color. In case of each of samples Nos. 1 and 2, the black color of the antistatic filamentary yarn could hardly be observed on the appearance of the dyed carpet.

EXAMPLE 2

Chipped nylon-6 (containing 2% by weight of titanium oxide) having a relative viscosity of 2.53 as measured in sulfuric acid was used as the electrically non-conductive core and sheath components, and the above-mentioned chipped nylon-6 containing 27.5% by weight of electrically conductive carbon black was used as the electrically conductive layer component. The former polymer was molten at 285° C. and the latter polymer was molten at 290° C., and the melts were filtered through a White Alundum filter layer, introduced to a spinneret pack as shown in FIG. 4 (the extrusion hole had a circular section) and composite-spun.

The volume ratio of the electrically non-conductive core and sheath layers to the electrically conductive layer in the spun filamentary yarn was adjusted to 90/10, and the volume ratio of the core to the sheath was adjusted to 10/80.

For reference, a coaxial two-layer filament comprising a core composed of the above-mentioned electrically conductive polymer and a sheath composed of the above-mentioned electrically non-conductive polymer (the volume ratio of the sheath to the core was adjusted to 90/10) was prepared as a comparative filament by composite spinning.

Each of the so obtained undrawn spun filaments was taken out at a speed of 800 m/min. and heat-drawn at a temperature of 170° C. and a draw ratio of 3.03 or 3.60.

Physical properties of undrawn and drawn filamentary yarns of the above-mentioned filaments were measured to obtain results shown in Table 2.

Table 2

| | Filament of Present Invention | | Comparative Filament | |
|---|---|---|---|---|
| Undrawn Filamentary Yarn | | | | |
| Fineness | 212.1 D (12 F) | | 210.9 D (12 F) | |
| Strength | 1.10 g/d | | 0.97 g/d | |
| Elongation | 416% | | 384% | |
| Uster unevenness | 2.6% | | 3.7% | |
| Drawn Filamentary Yarn | | | | |
| Draw Ratio | 3.03 | 3.60 | 3.03 | 3.60 |
| Fineness | 70.1 | 59.8 | 69.8 | 59.5 |
| Strength | 2.07 g/d | 3.45 g/d | 1.80 g/d | 2.74 g/d |
| Elongation | 72.5% | 45.4% | 55.6% | 30.2% |
| Uster unevenness | 2.09% | 1.49% | 3.51% | 2.20% |
| Specific resistance[1)] | $2.5 \times 10^3$ Ω-cm | $6.0 \times 10^4$ Ω-cm | $3.0 \times 10^3$ Ω-cm | $8.0 \times 10^4$ Ω-cm |
| Formation of knots[2)] | not observed | not observed | relatively many knots | hardly observed |

Note:
[1)]The specific resistance was determined according to the following method.
A sample of 1,000 D degreased by carbon tetrachloride was cut into a length of 10 cm, and an electrically conductive resin was coated on both the ends of the cut sample and was used as an electrode. At a temperature of 20° C. and a relative humidity of 65%, a direct current of 100 V was applied and the resistance was measured. The specific resistance (Ω-cm) was calculated from the measured value of the resistance.
[2)]The drawn yarn was formed into a cylindrical knitted fabric, and the presence or absence of knots was examined with the naked eye.

As will be apparent from the results shown in Table 2, in the antistatic filament of the present invention, since the electrically conductive carbon black-dispersed layer having a poor fiber forming property is supported from both the inner and outer sides by the core and sheath composed of a synthetic polymer having an excellent fiber forming property, the fineness unevenness is much smaller than in the comparative coaxial two-layer filament containing the sheath alone as the electrically non-conductive layer, and therefore, the filament of the present invention is excellent in the strength and elongation characteristics.

EXAMPLE 3

Chipped nylon-6 (containing 7% by weight of titanium oxide) having a relative viscosity of 2.80 as measured in sulfuric acid, in which 2.5% by weight of a block polyether amide composed mainly of poly-ε-caprolactum and polyethylene glycol had been chip-blended, was used as the electrically non-conductive core and sheath components. The above-mentioned chipped nylon-6 containing 28.2% by weight of electrically conductive carbon black, in which 2.5% by weight of the above-mentioned block polyether amide had been chip-blended, was used as electrically conductive layer component. Composite spinning was carried out under the same conditions as described in Example 2, and the spun filament was heat-drawn at a draw ratio of 3.03.

The physical properties of the so obtained antistatic filamentary yarn of the present invention were measured to obtain results shown in Table 3.

Table 3

| | |
|---|---|
| Draw ratio | 3.03 |
| Fineness | 72.0 D (12 F) |
| Strength | 2.4 g/d |
| Elongation | 62.0% |
| Specific resistance | $4.0 \times 10^3 \Omega$-cm |

When this filamentary yarn was compared with the filamentary yarn drawn at a draw ratio of 3.03, which was obtained in Example 2, it was found that the whiteness was remarkably improved in the filamentary yarn obtained in this Example.

EXAMPLE 4

The filamentary yarn of the present invention obtained in Example 2 by conducting heat drawing at a draw ratio of 3.6 was subjected to a false-twisting modifying treatment under conditions of a spindle rotation number of 300,000 rpm, a false twist number of 3,500 t/m, a primary heater temperature of 170° C., a primary overfeed rate of +3%, a secondary heater temperature of 185° C. and a secondary overfeed rate of +15%.

Throughout the treatment conducted for 8 hours, falling of black pieces or dusts on yarn guides and the like was not observed, and no trouble was caused during the treatment and a good processed yarn was obtained.

When the specific resistance of the processed yarn was measured, it was found that the specific resistance was $3.0 \times 10^4 \Omega$-cm and was reduced to about ½ of the value of the specific resistance of the starting unprocessed yarn.

EXAMPLE 5

Chipped nylon-6 (containing 0.03% by weight of titanium oxide) having a relative viscosity of 2.63 as measured in sulfuric acid was used as the electrically non-conductive core and sheath components, and the above-mentioned chipped nylon-6 containing 27.5% by weight of electrically conductive carbon black was used as the electrically conductive layer component. Composite spinning was carried out in the same manner as described in Example 2 except that the volume ratio of the core to the sheath was changed to 70/20.

The resulting undrawn spun filamentary yarn was heatdrawn at 170° C. at a draw ratio of 3.03, and the physical properties of the drawn filamentary yarn were measured to obtain results shown in Table 4. Data of the comparative filamentary yarn described in Example 2 are also shown in Table 4 for reference.

Table 4

| | Yarn of Present Invention | Comparative Yarn |
|---|---|---|
| Fineness | 69.8 D (12 F) | 69.8 D (12 F) |
| Strength | 2.01 g/d | 1.80 g/d |
| Elongation | 70.3% | 55.6% |
| Resistance | 50 MΩ/cm | 110 MΩ/cm |
| Specific resistance | $4.0 \times 10^3 \Omega$-cm | $3.0 \times 10^3 \Omega$-cm |

As will readily be understood from the results shown in Table 4, in the antistatic filamentary yarn of the present invention, since the thickness of the sheath can be reduced optionally, it is possible to reduce the resistivity, that is, to improve the antistatic property, as compared with the comparative filamentary yarn.

When the so obtained filamentary yarn was subjected to a false-twisting modifying treatment in the same manner as described in Example 4, it was found that a good processed yarn could be obtained without falling of black pieces or dusts.

This processed yarn had a dense black appearance and when it was used for the manufacture of a black fabric or grandrelle fabric, a good product was obtained.

What is claimed is:

1. An antistatic composite filament having a three-layer structure including a core layer, a sheath layer and an intermediate layer, each of which is continuous in the axial direction of the filament, said core layer being composed of an oriented and crystallized, electrically non-conductive synthetic polymer, said sheath layer being composed of a synthetic polymer of the same kind as of the polymer constituting the core layer and said intermediate layer being composed of an electrically conductive synthetic polymer containing carbon black dispersed therein and being present in the entire intermediate area between the core layer and sheath layer.

2. An antistatic composite filament as set forth in claim 1 wherein the polymer constituting the intermediate layer is of the same kind as of the polymer constituting the core and sheath layers.

3. An antistatic composite filament as set forth in claim 1 wherein the polymer constituting the core and sheath layers is a polyamide or polyester.

4. An antistatic composite filament as set forth in claim 1 wherein the polymer constituting the core and sheath layers is a polyamide containing 0.5 to 5% by weight of at least one member selected from the group consisting of polyalkylene glycols, derivatives thereof, block polyether-polyamides, block polyether-polyesters, N-alkyl polyamide and alkylene oxide adducts of polyamides.

5. An antistatic composite filament as set forth in claim 1 wherein the electrically conductive carbon black is dispersed in the synthetic polymer constituting the intermediate layer in an amount of 10 to 60% by weight.

6. A process for the preparation of antistatic composite filaments, which comprises dividing a molten, fiber-forming electrically non-conductive synthetic polymer into a core component steam and a sheath component stream in a spinneret pack, flowing a molten, electrically conductive synthetic polymer having electrically conductive carbon black dispersed therein around the periphery of the core component stream to form a two-layer stream, flowing the sheath component stream around the periphery of the two-layer stream to form a three-layer stream, extruding the three-layer stream from a spinneret hole, and orienting and crystallizing at least the core and sheath components.

* * * * *

UNITED STATES PATENT AND TRADEMARK OFFICE

CERTIFICATE OF CORRECTION

ATENT NO. :4,207,376

)ATED :June 10, 1980

NVENTOR(S) :Nagayasu et al

It is certified that error appears in the above-identified patent and that said Letters Patent is hereby corrected as shown below:

On the title page Insert

-- (30) Foreign Application Priority Data

June 15, 1978 Japan 53-72403 --

Signed and Sealed this

Twenty-eighth Day of August 1984

[SEAL]

Attest:

GERALD J. MOSSINGHOFF

Attesting Officer

Commissioner of Patents and Trademarks